United States Patent [19]

Chang

[11] Patent Number: 4,928,472

[45] Date of Patent: May 29, 1990

[54] CHAIR FOR REINFORCEMENT ROD

[76] Inventor: Jyh-Chin Chang, 38, Kuang-Ming St., Pei-Chen Li, Lo-Tung, Y:-Lan Hsien, Taiwan

[21] Appl. No.: 342,992

[22] Filed: Apr. 24, 1989

[51] Int. Cl.[5] ..... E04C 5/16

[52] U.S. Cl. ..... 52/678; 52/686; 52/687

[58] Field of Search ..... 52/686, 687, 677, 678

[56] References Cited

U.S. PATENT DOCUMENTS 4,060,954 12/1977 Liuzza ..... 52/677

*Primary Examiner*—Carl D. Friedman

*Attorney, Agent, or Firm*—Wells. St. John & Roberts

[57] ABSTRACT

A chair for concrete reinforcing rods includes a body having an intermediate portion which includes two spaced apart substantially rectangular planar transverse frame members interconnected by at least one pairs of substantially parallel first connecting members. Four parallel legs extend outwardly from each transverse frame adjacent to four corners of the frame. The legs from one of the frames are aligned with the legs from the other frame so that the legs lie in two pairs of parallel plane. The frame, legs, and the connecting members confine a plurality of channel-like support seats of different diemensions for locating reinforcement rods at different heights and spacings.

5 Claims, 6 Drawing Sheets

CHAIR FOR REINFORCEMENT ROD

BACKGROUND OF THE INVENTION

This application relates to a chair for supporting concrete reinforcement rods so that the rods are spaced properly from a floor when concrete is poured, and particularly to a chair for supporting concrete reinforcement rods which has a plurality of seat portions.

It is known in the art that reinforcement rod supports or chairs are provided in order to properly space reinforcement steel rods from each other and from a floor before the pouring of concrete. Various supports have existed in the art. Generally, conventional chairs have only one or two rod supporting seats and thus provide only one or two heights at which a rod can be located. Usually, different sizes of constructions such as columns or floors require different arrangements, spacings and sizes of reinforcement rods, and therefore chairs or support seats of different forms and specifications are needed for different spacings of reinforcement rods. Since the application of the conventional chairs is limited, the users must carry different chairs to their working site and select appropriate chairs for different uses, thereby causing inconveniences to the users and consuming time and labor.

SUMMARY OF THE INVENTION

An object of this invention is to provide a universal chair for supporting reinforcement rods, which provides different supporting heights and which can space the reinforcement rods from each other or from the floor at different distances.

Another object of this invention is to provide a universal chair for supporting concrete reinforcement rods, which can be used for fabricating different concrete constructions, thereby eliminating the work of selecting suitable chairs and reducing time-consumption.

According to the present invention, a chair for concrete reinforcing rods comprises a body having an intermediate portion which includes two substantially planar transverse frame members spaced apart from one another, each of the transverse frame members having two opposite ends and, at least one pair of substantially parallel first connecting members interconnecting the planar transverse frame members. The connecting members and the planar transverse frame members confine two channel-like first seats near the opposite ends of the planar transverse frame members. Two pairs of first leg members extend outwardly from one of the transverse frame members, the first leg members and the one transverse frame member confine a channel-like second support seat. Two pairs of second leg members extend outwardly from the other one of the transverse frame members, The second leg members and the other transverse frame member confine a channel-like third support seat.

In one aspect of the invention, at least one pair of substantially parallel second connecting rods are transverse to and interconnect one of the pairs of the first leg members, the second connecting rods being spaced apart from an adjacent one of the transverse frame members, the second connecting rods and the first leg members confining a channel-like fourth support seat.

In another aspect of the invention, a chair further comprises at least one pair of substantially parallel third connecting rods which are transverse to and interconnect one of the pair of the second leg members, the third connecting rods being spaced apart from an adjacent one of the transverse frame members, the third connecting rods and the second leg members confining a channel-like fifth support seat.

In still another aspect of the invention, the transverse frame members are substantially rectangular and have two pairs of opposite sides and four corners, each of the transverse frame members further having two pairs of projections which extend from one of the pairs of opposite sides adjacent to the four corners, the first and second leg members extending from the projections, the first leg members being parallel to each other and aligned respectively with the second leg members, said one pairs of the opposite sides of the transverse frame members, the aligned first and second leg members and adjacent projections confining channel-like sixth support seats.

The present exemplary preferred embodiment will be described in detail with reference to the accompanying drawings, in which

DETAILED DESCRIPTION OF THE PREFERRED EMBODIMENT

Figure 1:
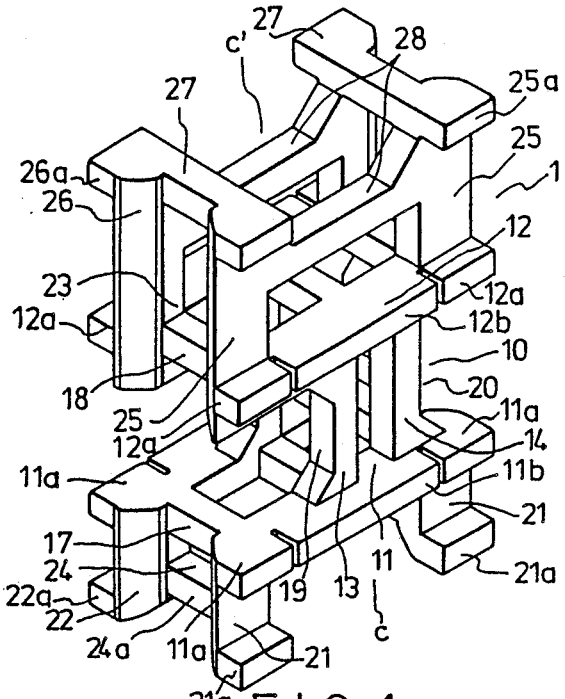
FIG. 1 is a perspective view of a chair according to the present invention.
Figure 2:
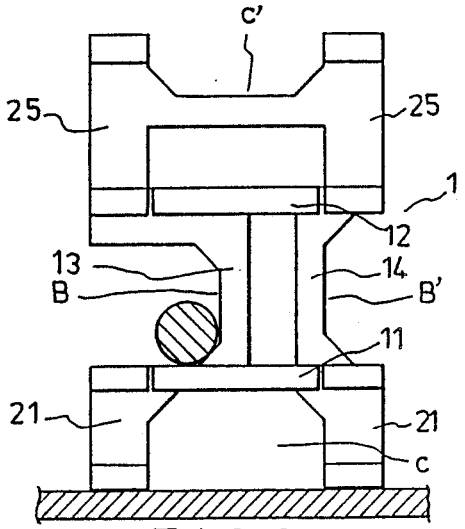
FIG. 2 is an elevation view of the chair of FIG. 1.

Referring to FIGS. 1 and 2, a chair for supporting concrete reinforcing rods includes a one-piece molded body 1 having an intermediate portion 10 which is comprised of two substantially planar frame members 11, 12 and four substantially parallel connecting rods 13, 14 interconnecting the frame members 11 and 12. The frame member 11 or 12 is substantially rectangular which has four projections 11*a* or 12*a* adjacent to the four corners thereof. The projections 11*a* or 12*a*confine opposite concavities 17 or 18 at two opposite sides of the frame members 11 or 12. The concavities 17 and 18 are aligned with one another and form two opposite channel-like support seats which will be described hereinunder.

Figure 3:
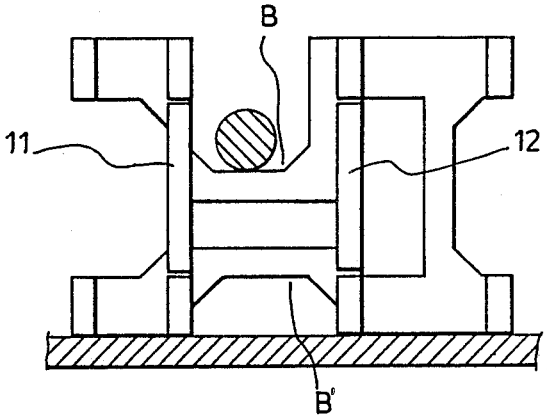
FIG. 3 is an elevation view of the chair of FIG. 1 in which one of the first support seats supports a reinforcement rod.
Figure 4:
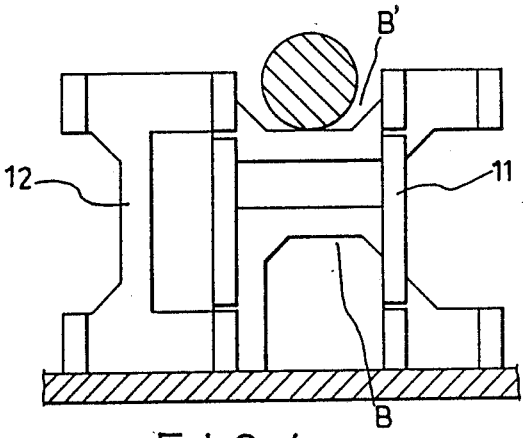
FIG. 4 is an elevation view of the chair which is reversed from the position shown in FIG. 3.

The connecting rods 13 and 14 are connected to the intermediate parts of the frame members 11 and 12 so that opposite concavities 19 and 20 are confined by the connecting rods 13, 14 and the frame members 11 and 12 near the opposite ends of the frame members 11, 12. The aligned pair of concavities 19 and 20 form a channel-like support seats B, B'. It can be seen that support seats B, B' provide two different supporting heights when the position of the chair is changed from that shown in FIG. 3 to that shown in FIG. 4.

Referring to FIG. 2 in combination with FIG. 1, two pairs of parallel legs 21 and 22 extend outwardly from the projections 11*a* of the frame member 11. The pair of legs 21 or 22 and the frame member 11 confine a channel-like support seat C.

Figure 5:
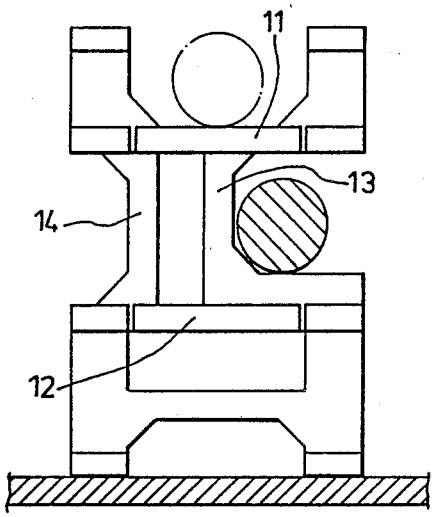
FIG. 5 is an elevation view of the chair which is reversed from the position shown in FIG. 2.

Another two pairs of legs 25, 26 extend outwardly from the projections 12*a* of the frame member 12. Each leg 25 and each leg 26 are interconnected by a connecting rod 27 The two legs 25 as well as the two legs 26 are interconnected by connecting rods 28. The legs 25, 26 and the connecting rods 27 and 28 also confine a channel-like support seat C′ opposite to the support seat C. It can be appreciated that support seats C, C′ provide different supporting heights as shown in FIGS. 2 and 5.

Figure 9:
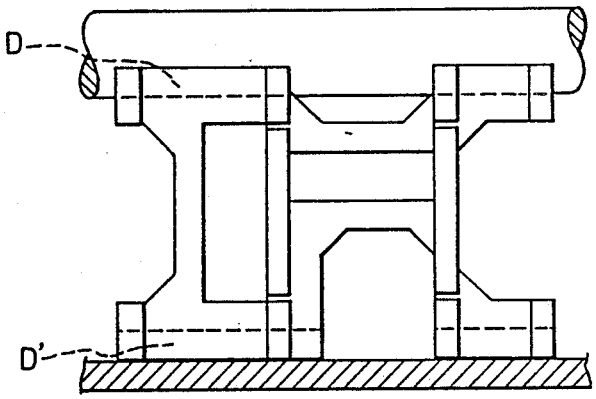
Figure 10:
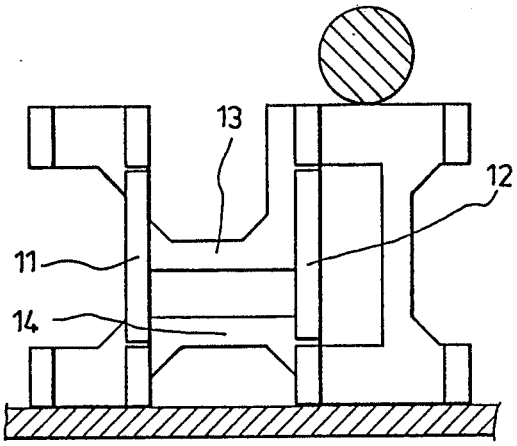
Figure 11:
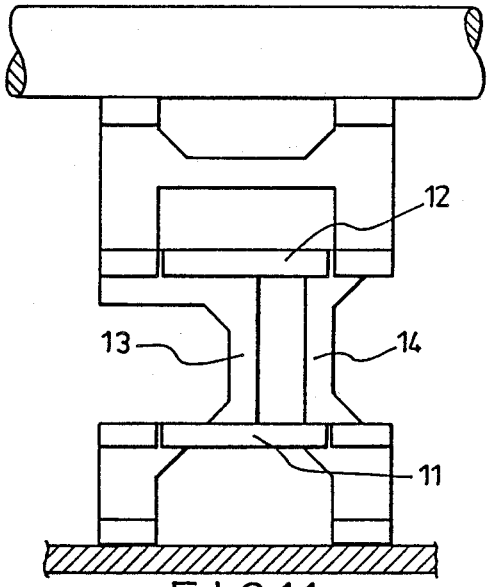
Figure 12:
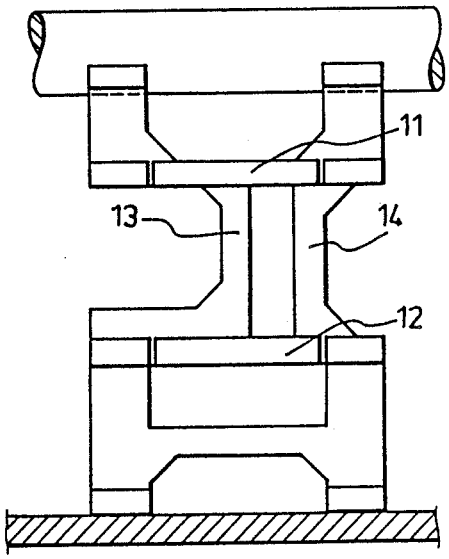
Figure 13:
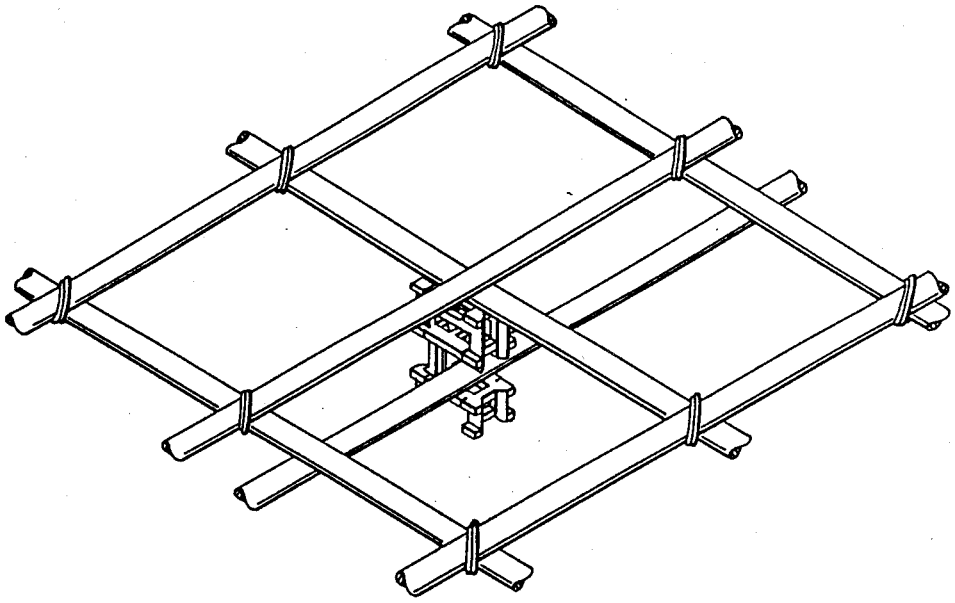
Figure 14:
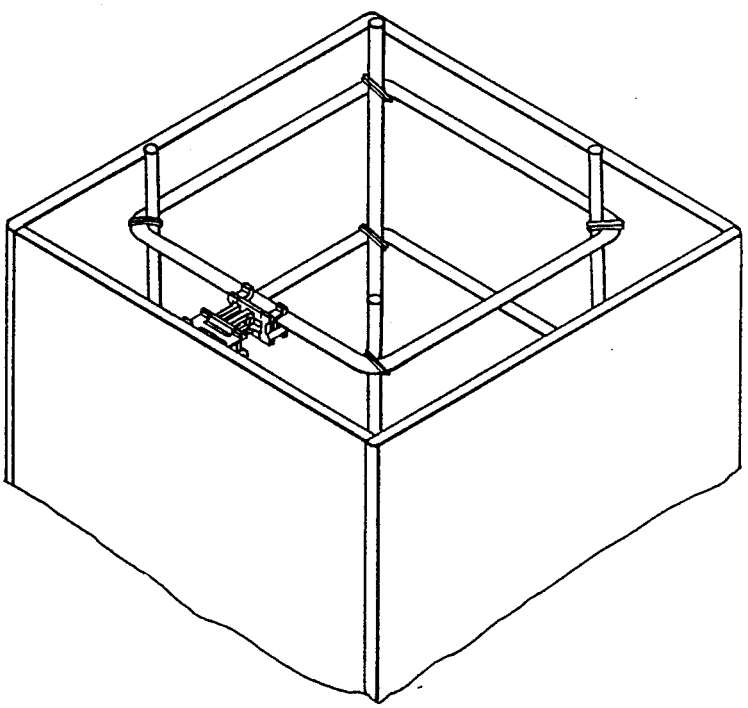

Each leg 21 is connected to each leg 22 at their ends by a connecting rod 24*a*. The pairs of legs 21 and 22 and the connecting rods 24*a* confine concavities 24 which are aligned with the concavities 17. Each leg 25 and each leg 26 are connected at their ends by a connecting rod 27. The pairs of legs 25, 26 and the connecting rods 27 confine two opposite concavities 23 which are aligned with the concavities 17, 18 and 24. The leg members 21, 22 are aligned respectively with the leg members 25, 26. The aligned leg members and aligned concavities 17, 18, 23, 24 form a channel-like support seats D, D′ as better shown in FIG. 9.

Figure 6:
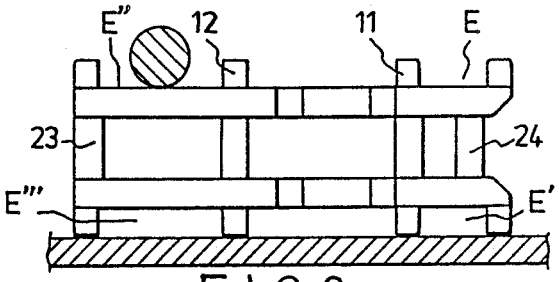
FIGS. 6 to 13 show different operating positions of the chairs.
Figure 7:
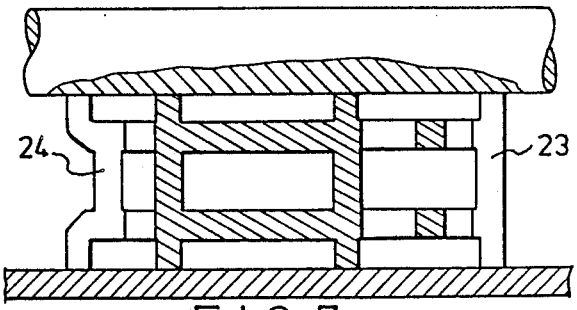
Figure 8:
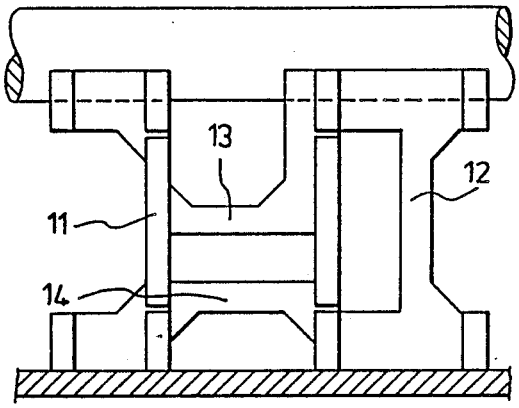

Referring again to FIG. 1, a pair of opposite sides of each transverse frame members 11 or 12 have two opposite marginal portions 11*b* or 12*b* projecting from the plane of the aligned leg members 21 and 25 and the plane of the aligned legs 22 and 26. The leg members 21, 22, 25 and 26 are provided with angled flanges 21*a*, 22*a*, 25*a* and 26*a* which are substantially parallel to the marginal portions 11*b* and 12*b*. The marginal portions 11*b*, 12*b* and the flanges 21*a*, 22*a*, 25*a* and 26*a* confine channel-like support seats E, E′, E″, E‴ as shown in FIG. 6.

From FIGS. 6 to 13, it can be appreciated that the chair of the present invention can support 5 reinforcement rods of different sizes at different heights by being placed in different positions.

With the invention thus explained, it is apparent that various modifications and variations can be made without departing from the scope of the present invention. It is therefore intended that the invention be limited only a indicated in the appended claims.

What I claim is:

1. A chair for concrete reinforcing rods comprising:

a body having a planar rectangular transverse top frame member and a planar rectangular transverse bottom frame member, each of said top and bottom frame members having a front side, a rear side, a left side and a right side, and two pairs of first connecting members placed between and connected to intermediate parts of said top and bottom frame members;

said body further having two pairs of first leg members respectively extending upward from the corners of said top frame member, and two pairs of second leg members respectively extending downward from the corners of said bottom frame member, said first connecting members and top and bottom frame members confining a left and right channel-like first support seat adjacent said left and right sides of said top and bottom frame members, said first leg members and said top frame member confining a channel-like second support seat, said second leg members and said bottom frame member confining a channel-like third support seat, said second support seat being operative and said left and right sides of said bottom frame member serving as an additional lower level supporting seat when said second leg members are placed downward, said third support seat being operative and said left and right sides of said top frame member serving as an additional lower level supporting seat when said first leg members are placed downward, said first and second leg members being different in length so that said second and third support seats provide different supporting levels, said left first support seat being operative when said right sides of said top and bottom frame members are placed downward, said right first support seat being operative when said left sides of said top and bottom frame members are placed downward, said first connecting members having different distances from said left and right sides of said top and bottom frame members so that said left and right first support seats provide different supporting levels.

2. A chair as claimed in claim 1, further comprising at least two substantially parallel second connecting rods which respectively interconnect two pairs of said first leg members, said second connecting rods and said first leg members confining a channel-like fourth support seat.

3. A chair as claimed in claim 2, further comprising at least two substantially parallel third connecting rods which respectively interconnect two pairs of said second leg members, said third connecting rods and said second leg members confining a channel-like fifth support seat.

4. A chair as claimed in claim 3, wherein said top and bottom transverse frame members are parallel, said first connecting members are parallel, and said first and second leg members are parallel.

5. A chair for concrete reinforcing rods comprising:

an elongated body having transverse top and bottom frame members, each having front, rear, left, and right sides, and first connecting members between and connected to intermediate parts of said top and bottom frame members;

said body further having first leg members extending upward from said top frame member, second leg members extending downward from said bottom frame member;

first support seats adjacent said left and right sides of said top and bottom frame members;

said top frame member confining a second support seat;

said bottom frame member confining a third support seat;

said second support seat being operative and said left and right sides of said bottom frame member serving as an additional lower level supporting seat when said second leg members are placed downward;

said third support seat being operative and said left and right sides of said top frame member serving as an additional lower level supporting seat when said first leg members are placed downward, said first and second leg members being different in length so that said second and third support seats provide different supporting levels;

said left first support seat being operative when said right sides of said top and bottom frame members are placed downward, said right first support seat being operative when said left sides of said top and bottom frame members are placed downward; and said first connecting members having different distances from said left and right sides of said top and bottom frame members so that said left and right first support seats provide different supporting levels.

* * * * *